United States Patent [19]

Cerioni

[11] 3,943,687

[45] Mar. 16, 1976

[54] APPARATUS FOR TAKING-UP AND CONVEYING BAGS

[75] Inventor: Renzo Giuseppe Cerioni, Milan, Italy

[73] Assignee: El Cu S.p.A., Italy

[22] Filed: Mar. 12, 1975

[21] Appl. No.: 557,818

Related U.S. Application Data

[63] Continuation of Ser. No. 423,128, Dec. 10, 1973, abandoned.

[30] Foreign Application Priority Data

July 18, 1973 Italy ..... 26724/73

[52] U.S. Cl. ..... 53/188; 53/386

[51] Int. Cl.[2] ..... B65B 43/30

[58] Field of Search ..... 53/29, 188, 386

[56] References Cited

UNITED STATES PATENTS

| | | | |
|---|---|---|---|
| 2,684,191 | 7/1954 | Dolman | 53/386 X |
| 3,050,918 | 8/1962 | Helm et al. | 53/386 |
| 3,503,179 | 3/1970 | Pierre | 53/386 X |

*Primary Examiner*—Travis S. McGehee

*Attorney, Agent, or Firm*—McGlew and Tuttle

[57] ABSTRACT

A method and apparatus for taking-up and transferring paper or plastic bags, one at a time, from a bag pile to a bag filling station and then to possible further operations, and wherein each bag is taken-up from the upper end of the pile and transferred, by means of rotary motions about suitable axes, firstly from a horizontal position to a vertical one and then, within the vertical plane containing the bag in the vertical position, to a position wherein the bag filling opening is substantially horizontal. Simultaneously with the second bag transferring motion, the bag wall portions adjacent to the bag filling opening are spaced apart from one another, for allowing the engagement thereof with the outlet mouth of a filling hopper, at the end of the second bag transferring motion.

4 Claims, 4 Drawing Figures

APPARATUS FOR TAKING-UP AND CONVEYING BAGS

This is a streamline continuation of application Ser. No. 423,128 filed Dec. 10, 1973, now abandoned.

BACKGROUND OF THE INVENTION

This invention relates to a novel and improved method, as well as to a related apparatus, for automatically performing a set of operations on bags made of paper, plastics or the like, in order to successively transfer the bags, one at a time, from a taking-up station to a filling station, and then to forward the same to possible further operations, e.g. a sealing operation of the bag filling opening.

SUMMARY OF THE INVENTION

An object of this invention is to provide a method and a related apparatus to perform bag taking-up and transferring operations in a wholly automatic, continuous and reliable manner, and by means of easily controlled operating components adapted to ensure an accurate positioning of single bags in a filling station.

According to this invention, a method for taking-up bags from a pile thereof, conveying them to a filling station and forwarding the filled bags to possibly required further operations, is essentially characterized in that each time the first bag in the pile is taken-up therefrom and initially transferred from a position substantially coincident with a horizontal plane to a position substantially coincident with a vertical plane, whereupon the bag is transferred within the vertical plane to a position wherein the filling opening thereof is substantially horizontal and simultaneously the bag wall portions adjacent the filling opening are spaced apart from one another to engage the bag filling opening with the outlet mouth of a filling hopper or the like at the end of the second transferring motion, the bag being kept in such an engaged filling position at least for a time sufficient for filling thereof, and then forwarded to possibly required further operations.

In order to carry-out the above method, an apparatus according to this invention comprises bag transferring means, preferably in the form of arms that are pivotal about suitably positioned axes and are provided with temporarily operable bag retaining means, namely sucking means that are controllably connected to a vacuum source.

DESCRIPTION OF THE PREFERRED EMBODIMENT

Figure 1:
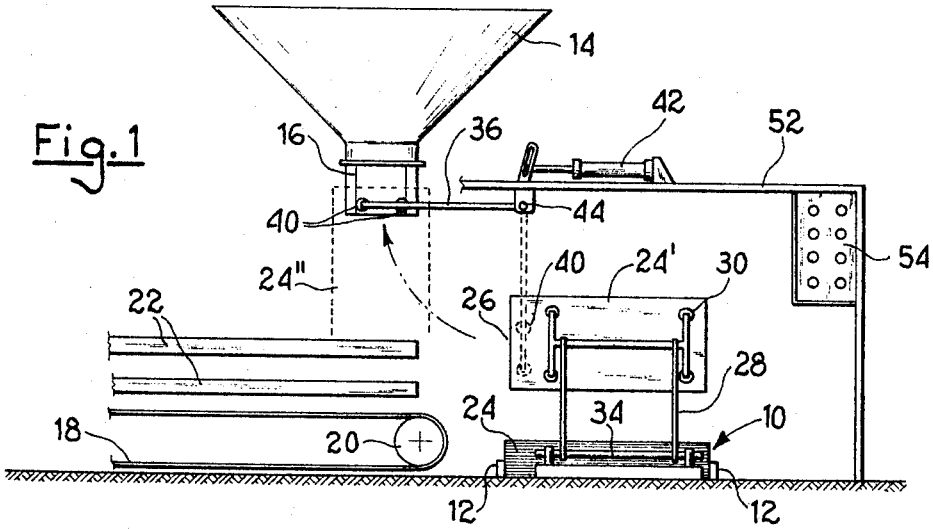
FIGS. 1 to 3 are, respectively, a side elevation view, a plan view and a front elevation view of a diagrammatically shown bag taking-up and transferring apparatus according to this invention.

Referring now to the drawings and initially to FIGS. 1 to 3, the shown apparatus operates as follows: a plurality of bags made of any suitable material, as e.g. paper, plastics or the like, are arranged in a bag pile 10, suitably positioned between retaining elements 12. The bags are transferred one at a time from pile 10 to a filling station, comprising a filling hopper 14 having a discharge mouth 16, wherefrom the filled bags are then forwarded to further stations for sealing the bag filling opening or the like by suitable means, e.g. in the form of a belt conveyor 18, 20 cooperating with retaining side guides 22.

In more detail, the apparatus successively transfers each bag from pile 10 to filling station 14, 16 in a wholly automatic manner, and engages the open end of each bag with outlet mouth 16 of hopper 14 in order to allow a filling operation of the bag. The conveying and engaging operations essentially comprise a first bag movement carried-out on the upper bag of pile 10 in order to transfer the bag from an essentially horizontal position 24, on the pile upper end, to an essentially vertical position 24' wherein the bag lies in a vertical plane, preferably extending through the outlet mouth 16 of hopper 14 and possibly coincident with one axis of the outlet mouth. The bag is then moved within the vertical plane to bring the filling opening 26 thereof in a horizontal position corresponding to that of the hopper outlet opening 16, and simultaneously the bag walls are spaced apart to engage the filling opening thereof with the hopper outlet in a filling position as shown by the reference 24'' in FIG. 1.

In order to carry-out the above operations, the apparatus comprises conveyor means that cooperate with temporarily operable bag retaining means and consist of arms pivotal about suitably positioned axes in order to move the bags along circular paths. In more detail, the first bag motion from a horizontal position 24 to a vertical position 24' is performed by arms 28, carrying a plurality of suitably controlled suckers 30, that are turned e.g. by a pneumatic cylinder-piston unit 32 about an axis 34 which is parallel to or coincident with the vertical plane as defined by the bag in its position 24' as well as preferably parallel to one of the bag sides.

The bag is then transferred from the position 24' to the position 24'' by a pair of arms 36, 38 each of which carries retaining suckers 40 adapted to engage the opposite bag walls near the bag opening 26, as shown in FIG. 1. Arms 36, 38 are caused to rotate e.g. by a pneumatic cylinder-piston unit 42 about a common axis 44 that is perpendicular to the vertical plane wherein the bag is moved. Simultaneously with the last bag transferring motion, arms 36, 38 are spaced apart from one another e.g. by a pneumatic cylinder-piston unit 46, in order to bring the bag in an open position and slip the same on the discharge mouth 16 of hopper 14. In order to effect engagement of the bag opening with hopper mouth 16, the axis 44 of arms 36, 38 is positioned in such a manner that the path of bag opening during the second transferring motion has an end stroke having an upwardly directed component. It is to be pointed out that, while in the shown embodiment the bag is rotated through 90° from the position 24' to the position 24'', it is however also possible to maintain the bag orientation during the second transferring motion by providing suitable articulated joints between the retaining means or suckers and the motion performing arms.

The bag when engaged with the hopper mouth 16 is then firmly retained in such a position by a pair of jaws 48, 50 that are suitably operated in order to press the bag walls from the outside against the hopper mouth walls and then retain the bag in such a position for a time at least sufficient for filling thereof, whereafter jaws 48, 50 are opened to cause the bag to fall onto belt conveyor 18 that conveys the same to possibly required further operations.

Figure 2:
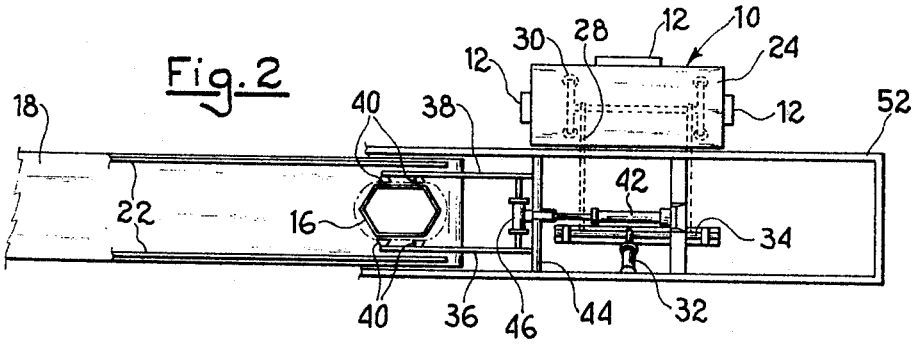
Figure 3:
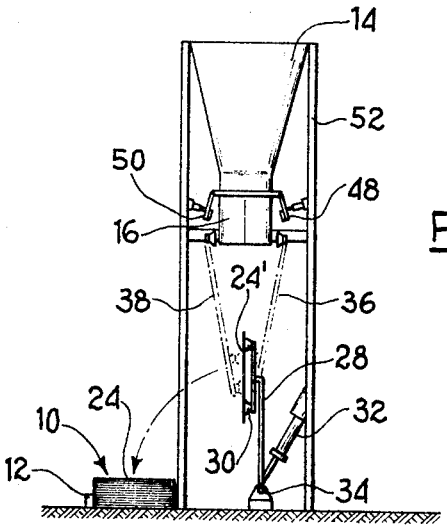

As it can be noticed from FIGS. 1 to 3, the described apparatus is supported by a suitable framework 52, carrying a control panel 54.

Figure 4:
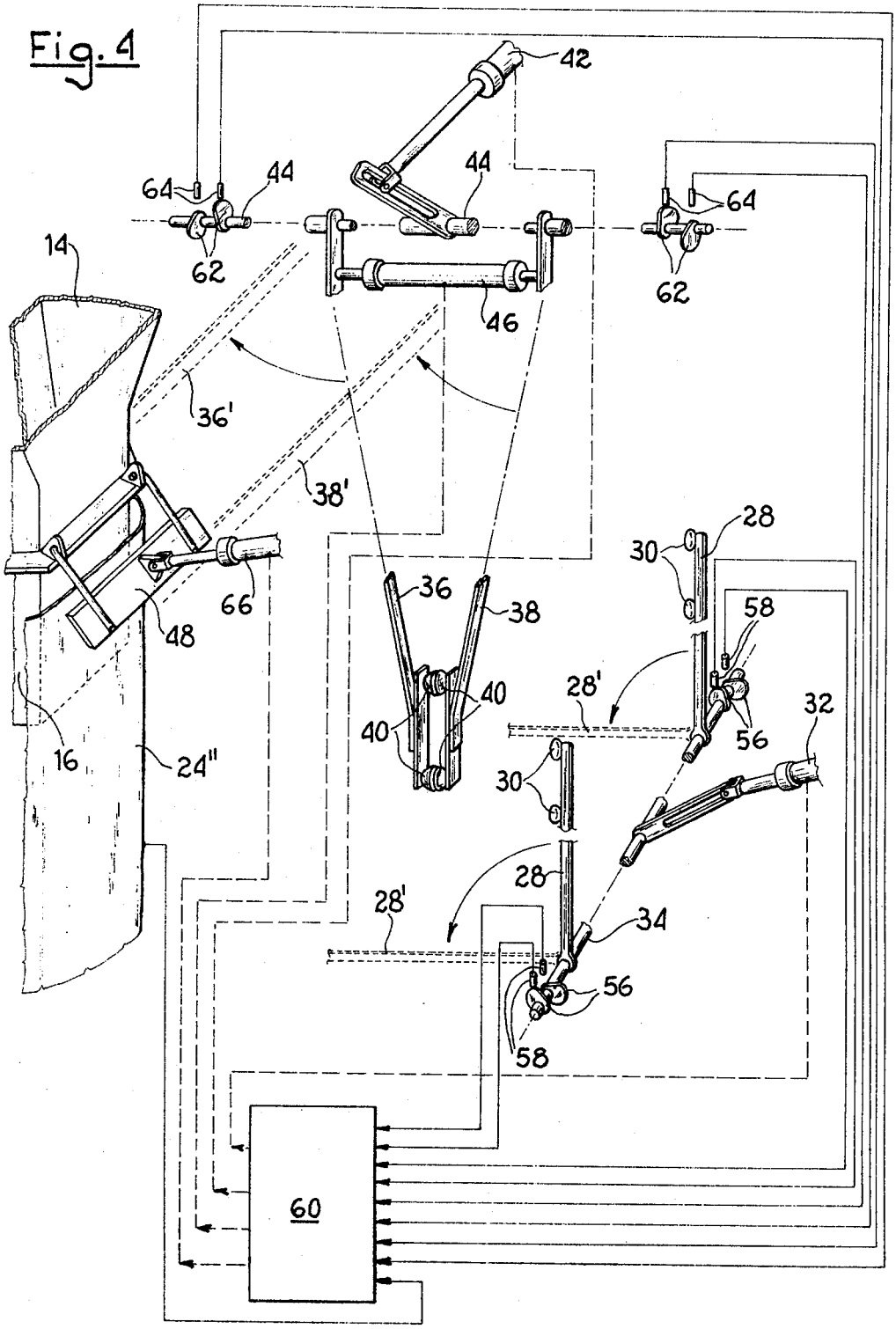
FIG. 4 is an exploded diagrammatic perspective view of components of the apparatus as well as of control and signal connections for automatically carrying-out the bag taking-up and transferring operations.

Referring now to FIG. 4, the different operating components of the described apparatus are diagrammatically shown in perspective along with some of the controls, signals and follow-up links as required for a continuous automatic operation thereof. The different apparatus components that carry the same reference numerals of the preceding figures will be hereinafter described in connection with their operation.

Starting from a condition wherein a bag to be taken-up is yet lying on the pile 10, the arms 28 are brought into a horizontal or substantially horizontal position 28' and the related sucking means 30 are connected with a vacuum source, e.g. by the action of one of control cams 56 suitably mounted on axis or shaft 34. Each cam 56 operates on a related microswitch 58 to close a corresponding circuit in a control station 60. All subsequent apparatus motions and operating steps are controlled, in due times, by follow-up and signal systems similar to those previously described and comprising further cams 62 on shaft 44 to cooperate with related microswitches 64. As previously stated, the follow-up and signal system is only partly and diagrammatically shown in FIG. 4, as the operating components thereof may have different designs as well known by those skilled in the art, provided that they operate as will be hereinafter described.

Once a bag has been taken-up by suckers 30, a signal is given for the motion of arms 28 that is performed by the pneumatic cylinder-piston unit 32 acting e.g. on the axis 34. Arms 28 are then brought into a vertical position together with the bag held by them. On attaining the bag vertical position or even slightly before the attainment of such a position, a signal is given for a lowering motion of arms 36, 38 as performed by the pneumatic cylinder-piston unit 42, that operates on the shaft 44. Simultaneously, at least the ends of arms 36, 38 are approached toward each other by the cylinder-piston unit 46 to bring their sucking means 40 to engage the opposite bag sides and adjacent to the bag opening nearly in a position as shown in FIG. 1.

At this time, the suckers 40 are connected with the vacuum source and then the suckers 30 are successively disconnected from the vacuum source, whereby the bag is held by the suckers 40 only. Then a lifting signal is sent to the pneumatic cylinder-piston units 42 and 46, in order to turn the arms 36 and 38 about the axis 44 and simultaneously space these arms apart from one another. The arms are thus brought into their horizontal positions 36' and 38', carrying the bag in the shown position 24'' wherein the bag opening engages with the outlet mouth 16 of hopper 14.

Jaws 48 and 50 are then closed by related pneumatic cylinder-piston units 66 and the bag is held by these jaws against the hopper mouth 16 during the filling operation thereof since the suckers 40 may be disconnected. Further controls operate a timed or at any rate strictly controlled opening of the hopper outlet mouth for filling the bag with a pre-established amount of material, whereupon jaws 48 and 50 are spaced-apart and the filled bag is allowed to fall onto belt conveyor 18. During the bag filling operation, or at the end thereof, the cylinder-piston unit 32 is operated into order to bring the arms 28 back in their substantially horizontal position 28', wherein a next operating cycle may be started on a further bag.

It is to be understood that while this invention has been described in detail with reference to a preferred embodiment thereof, many changes and modifications may be made therein without departing from the true scope of the invention.

I claim:

1. Apparatus for filling empty bags comprising, in combination, a filling station including an elevated hopper having a stationary vertically oriented hopper outlet mouth; empty bag support means spaced longitudinally and laterally from said filling station at a level very substantially below said hopper outlet mouth, and adapted to support a pile of empty bags in vertically superposed horizontally oriented relation; a first sub-assembly including first arm means laterally aligned with and spaced from said empty bag support means and pivotal about a first horizontal axis located in a vertical plane intersecting said stationary hopper outlet mouth, bag gripping means on said first arm means spaced from the pivot axis thereof, and first actuator means operable to swing said first arm means about said first axis laterally and downwardly toward said bag support means to grip the exposed side wall of the top bag of the pile at a zone spaced from its filling mouth, and then to swing said first arm means laterally and upwardly in a circular arc about said first horizontal axis into said vertical plane at a level intermediate the levels of said bag support means and said hopper outlet mouth, with the bag filling mouth facing horizontally toward said stationary hopper outlet mouth; a second sub-assembly including second arm means pivotal about a second horizontal axis perpendicular to such vertical plane and at an elevation above said first axis substantially equal to the elevation of said hopper outlet mouth, said second arm means including a pair of opposed arms pivotal about said second horizontal axis and mounted for movement of their free ends toward and away from each other, and including second gripping means on said opposing arms spaced from said second horizontal axis, second actuator means operable to swing said second arm means from a horizontally oriented position into a vertically oriented position for engagement of said second gripping means with both side walls of the vertically oriented bag, supported by said first arm means, adjacent the bag filling mouth, and operable to swing said second arm means in a circular arc longitudinally and upwardly about said second horizontal axis toward said hopper outlet mouth, and third actuator means operable, during movement of said second arm means toward said stationary hopper outlet mouth, to separate the free ends of said pair of opposed arms to separate the opposite side walls of the bag to open the filling mouth thereof for slipping fo the bag filling mouth upwardly over the stationary hopper outlet mouth; and means operable to clamp the bag filling mouth against the outer surface of said stationary hopper outlet mouth; said stationary hopper outlet mouth being located at a distance above said empty bag support means substantially equal to the sum of the vertical motions of said two sub-assemblies.

2. Apparatus as claimed in claim 1, in which said first and second gripping means comprise first and second suction means; and control means selectively operable to connect said first and second suction means to a source of vacuum.

3. Apparatus as claimed in claim 2, in which said control means is initially operable to connect said first suction means to the source of vacuum for gripping the exposed side wall of the top bag of the pile, is then operable to connect said suction means to the source of vacuum for gripping both side walls of the vertically oriented bag supported by said first suction means, is then operable to disconnect said first suction means from the source of vacuum, and is operable, after operation of said clamping means, to disconnect said second suction means from the source of vacuum.

4. Apparatus as claimed in claim 3, in which said control means is operable to connect said second suction means to the source of vacuum while said pair of opposed arms are vertically oriented and engaged with the opposite side walls of the bag before swinging movement of the pair of opposed arms longitudinally and upwardly toward the hopper outlet mouth.

* * * * *